United States Patent [19]

Phillips et al.

[11] 4,116,588

[45] Sep. 26, 1978

[54] FLUID PUMP

[75] Inventors: Ronald Phillips, Northolt; James Campbell Melville, Acton, both of England

[73] Assignee: Lucas Industries Limited, Birmingham, England

[21] Appl. No.: 713,909

[22] Filed: Aug. 12, 1976

[30] Foreign Application Priority Data

Jun. 22, 1976 [GB] United Kingdom ..... 25824/76

[51] Int. Cl.[2] ..... F04C 11/00

[52] U.S. Cl. ..... 417/252; 418/9; 418/60

[58] Field of Search ..... 418/5, 9, 11, 12, 13, 418/60, 61 B, 212, 213, 215, 209, 210, 135; 417/247, 252

[56] References Cited

U.S. PATENT DOCUMENTS

| | | | |
|---|---|---|---|
| 949,638 | 2/1910 | Stormer | 418/212 |
| 2,593,602 | 4/1952 | Pool et al. | 417/252 |
| 3,106,871 | 10/1963 | Stein | 418/11 |
| 3,801,239 | 4/1974 | Larson | 418/61 B |
| 3,941,526 | 3/1976 | Kutkus | 418/60 X |
| 3,944,378 | 3/1976 | McDermott | 418/60 |

FOREIGN PATENT DOCUMENTS

| | | | |
|---|---|---|---|
| 610,644 | 12/1960 | Canada | 418/135 |
| 1,270,648 | 7/1961 | France | 418/135 |

*Primary Examiner*—Carlton R. Croyle
*Assistant Examiner*—Leonard E. Smith

[57] ABSTRACT

A fluid pump includes a housing in which is defined a bore. A pump assembly is mounted within the bore a pump assembly including a drive shaft extending through an aperture in an end wall serving to close one end of the bore, the other end of the bore being closed by an end closure. The pump assembly comprises three stator portions and disposed in end to end relationship with each end stator portion and the center stator portion being separated by components of two stages of the pump.

11 Claims, 2 Drawing Figures

FLUID PUMP

Figure 1:
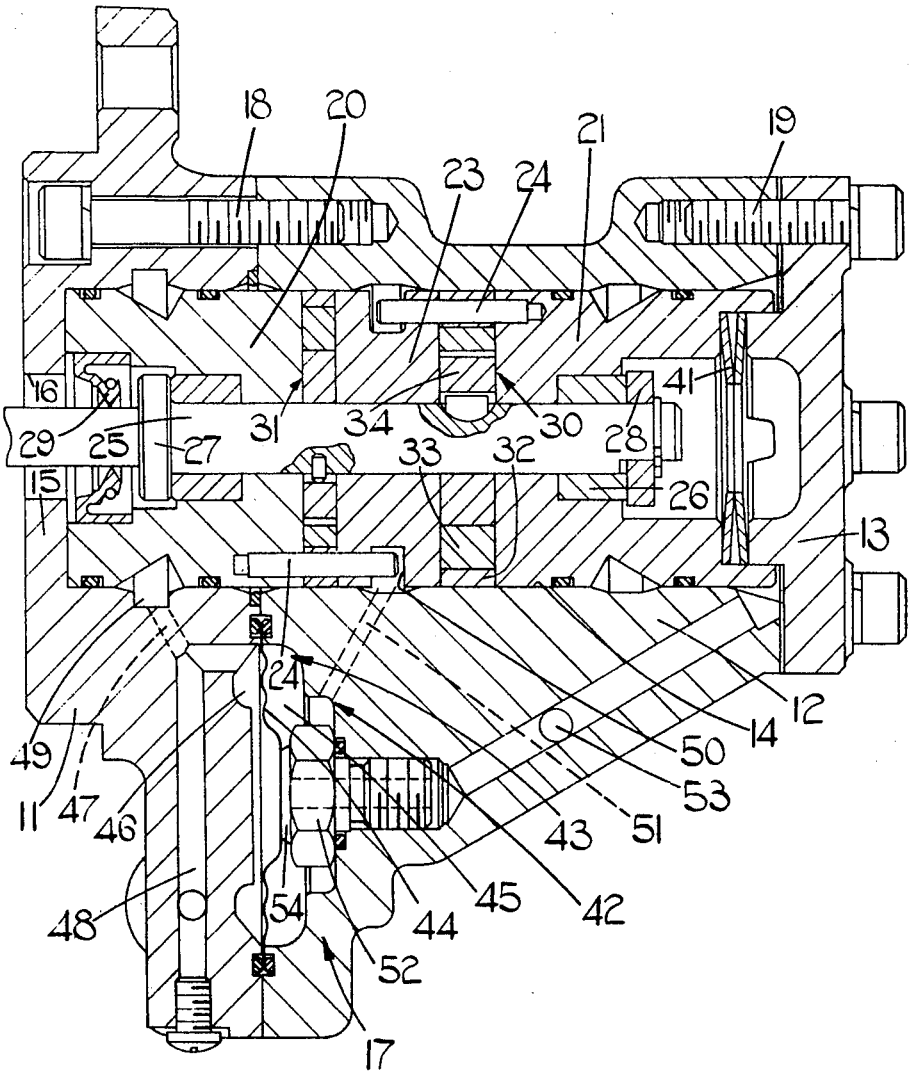
Figure 2:
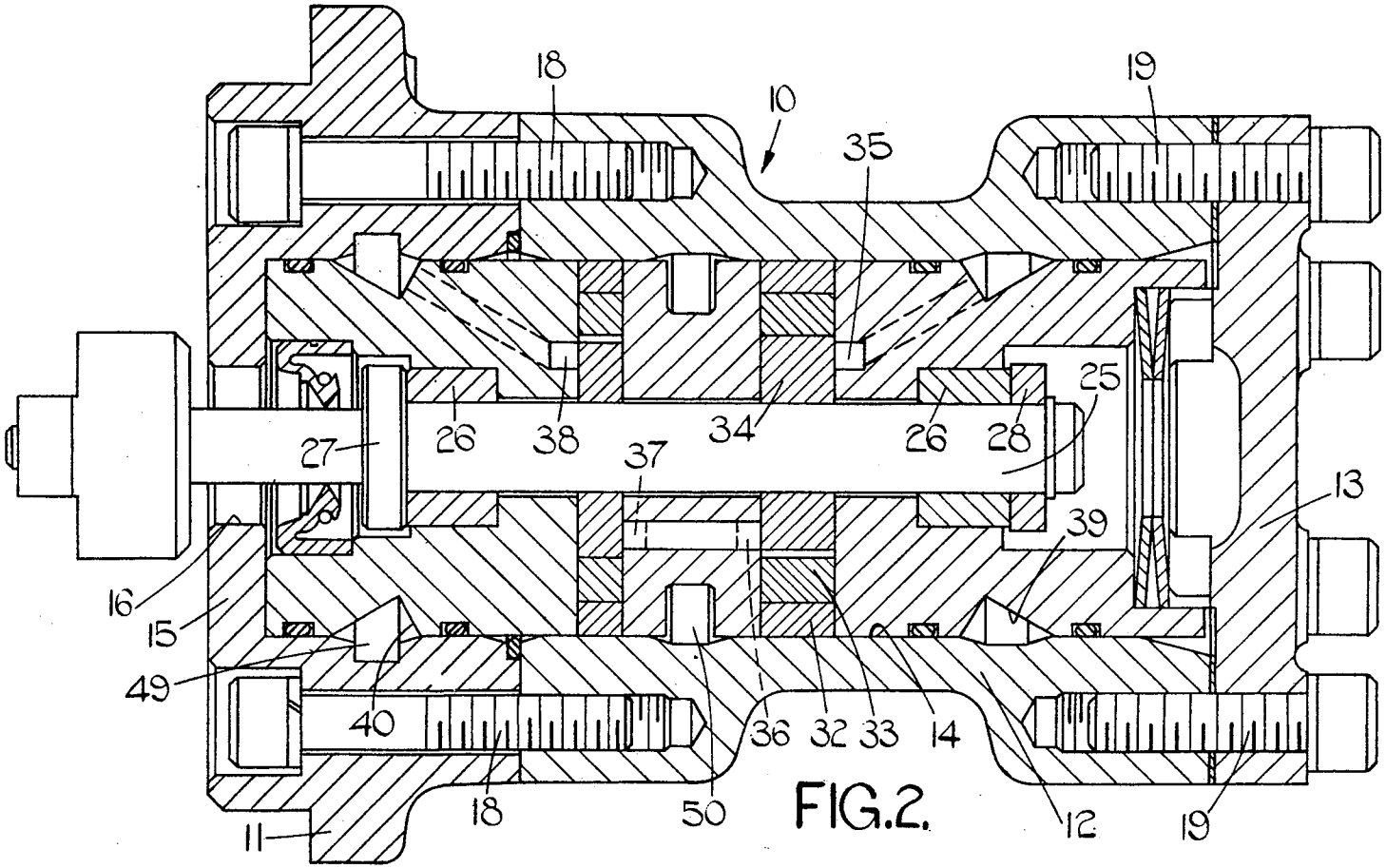

This invention relates to a fluid pump of the kind comprising two pumping stages connected in series and driven by a common shaft and the object of the invention is to provide such a pump in a simple and convenient form.

According to the invention a fluid pump of the kind specified comprises a housing defining a bore, a pump assembly mounted within the bore, said pump assembly including a drive shaft extending through an aperture in an end wall serving to close one end of the bore, an end closure forming part of said housing and serving to close the other end of said bore, and said pump assembly comprising three stator portions disposed in end-to-end relationship with each end stator portion and the centre stator portion being separated by components of one of said pumping stages.

One example of a fluid pump in accordance with the invention will now be described with reference to the accompanying drawings in which the two figures are sectional side elevations of the pump taken at right angles.

Referring to the drawings, the pump unit has a housing 10 which is formed in three parts 11, 12 and 13. The parts 11 and 12 define a cylindrical bore 14 and the part 13 forms an end closure for this bore. The other end of the bore is partly closed by an end wall 15 defined by the part 11 and in this end wall is formed an aperture 16. The joint between the housing parts 11 and 12 extends transversely of the axis of the bore and in addition, the parts 11 and 12 have a lateral extension which accommodates a valve 17.

Located within the bore 14 is a pump assembly which can be inserted into the bore after the parts 11 and 12 of the housing have been secured together by means of bolts 18. When the pump assembly is located within the bore the part 13 of the housing is secured by bolts 19 to the part 12 of the housing and the assembly of the pump is then complete.

Considering now the pump assembly this comprises a pair of outer stator portions 20, 21 and an intermediate stator portion 23. The stator portions are located angularly relative to each other by means of dowel pins 24.

The stator portions are provided with centrally disposed apertures through which extends a drive shaft 25 and this is journalled in annular carbon bearings 26 carried by the stator portions 20, 21 respectively. The shaft 25 near its end adjacent the end wall 15 is provided with a flange 27 and at its other end there is mounted a thrust member 28 which is retained upon the shaft by means of a circlip. Moreover, the stator portion 20 mounts an oil seal 29 which engages with the shaft at a position intermediate the flange 27 and the end wall 15. The shaft extends through the aperture 16 and carries a coupling by which it is coupled to an electric drive motor.

Located between the stator portions 21 and 23, are the components of the first stage 30 of the pump and located between the stator portions 20 and 23 are the components of the second stage 31 of the pump. Each stage is a gyratory pump and the two stages are of identical construction with the exception that the first stage is dimensioned so that it pumps substantially twice the amount of fuel capable of being pumped by the second stage. A brief description of the construction of the stages will now be made with reference to stage 30 only.

The stage comprises an outer annular member 32 which has an aperture therein through which passes the dowel pin 24. The member 32 is thus constrained against angular movement. The cylindrical aperture defined in the outer member is eccentrically disposed relative to the axis of rotation of the shaft 28. Moreover, located within the aperture is an inner annular member 33 having an outer plain cylindrical surface and an inner surface in which are formed gear teeth. Finally, the stage includes a gear 34 which is mounted about the shaft 28 and keyed thereto so as to rotate with the shaft. As the shaft rotates the member 33 will also be rotated but during such rotation will partake of gyratory movement.

An arcuate fuel inlet groove 35 is provided in the stator portion 21 and an arcuate fuel outlet 36 is provided in the stator portion 23. The outlet 36 communicates with an inlet 37 for the stage 31 and this is provided with an outlet 38 formed in the stator portion 20. The outlet 36 and the inlet 37 are interconnected by a passage formed in the stator portion 23. As will be seen, the passage extends through the stator portion 23 substantially parallel to the axis of rotation of the shaft and to enable this to be done, the two stages are disposed at 180° relative to each other about the axis of the shaft. The inlet 35 communicates with a circumferential groove 39 formed in the periphery of the stator portion 21 whilst the outlet 38 communicates with a groove 40 formed in the stator portion 20. On each side of the grooves 39, 40 the respective stator portions are provided with grooves which accommodate seal rings and the arrangement is such that when the pump assembly has been assembled it can be pushed axially into the bore 14 to the position shown in the drawings, in which the end face of the stator portion 20 engages the end wall 15 of the portion 11 of the housing. The pump assembly is retained in position by means of a pair of Belleville washers 41 which are located within an internal recess formed in the stator portion 21. The Belleville washers 41 are engaged by a projection formed on the housing part 13. A small clearance is provided between the end of the stator portion 21 and the part 13 of the housing to permit differential expansion of the housing and the pump assembly which in the particular example are formed from dissimilar metals, the housing being formed from aluminium alloy whilst the pump assembly is generally formed from steel.

The two stages of the pump are in effect positive displacement gear pumps and the rate of delivery is controlled by varying the speed of rotation of the shaft. The particular example of pump is required to be able to deliver fuel at a very low rate and at this low rate leakage of fuel within the stage of the pump is a problem. The accuracy of delivery is therefore ensured by the provision of a valve generally indicated at 42 which ensures that the pressure drop across the second stage of the pump is substantially zero. The valve 42 includes a valve chamber 43 defined between the two housing portions 11 and 12. Extending across the chamber is a diaphragm 44 which divides the chamber into two parts 45, 46. The chamber part 46 communicates with the circumferential groove 40 by way of a passage 47 and this passage extends by way of a passage 48 to an outlet (not shown) on the housing portion 11. It will be noted that the bore 14 is formed with a groove 49 in register with the groove 40, furthermore, the bore is tapered on opposite sides of the groove and this is to minimise damage to the seals when the pump assembly is inserted into the bore. The portion 45 of the chamber 43 is connected to a further groove 50 formed in the peripheral surface of the stator portion 23 by way of a passage 51 and this groove communicates with the passage interconnecting the ports 36, 37.

Also located in the chamber portion 45 is an outlet which is defined in a member 52 threaded into the housing portion 12. This outlet communicates with a drain outlet 53 which in use communicates with a drain. The drain outlet 53 also communicates with the space defined between the pump assembly and the portion 13 of the housing. The groove 39 formed on the pump assembly communicates with an inlet.

It will be seen that the diaphragm 44 is exposed on one side to the pressure intermediate the two stages of the pump and on the other side to the pressure at the outlet of the second stage. It has already been mentioned that the first stage of the pump is capable of pumping substantially twice the volume of fuel as compared with the second stage and therefore under most conditions of use, the diaphragm 74 will be displaced so as to permit surplus fuel to flow to the drain outlet 53. The effect of the diaphragm since it has a low rate, is to ensure that there is substantially no pressure drop across the second stage of the pump, so that the output of the pump is directly proportional to the speed at which the shaft 26 is rotated.

The diaphragm 44 at its periphery, is sandwiched between the two portions 11, 12 of the housing and annular sealing rings are disposed on the opposite sides of the diaphragm, the sealing rings being located within annular grooves formed in the housing parts. The diaphragm is formed from a berrylium copper alloy conveniently as a pressing and in the particular example a central disc 54 is provided which co-operates with the member 52 to control the flow of fuel through the outlet. The diaphragm may however by suitably shaped so that it is not necessary to provide the disc. Moreover, it may be formed from other materials such, for instance as a synthetic rubber. Experience has shown that there is no real need to provide for adjustment of the axial position of the member 52. In some cases, however, this may be desirable and in such cases the member 52 is extended to the periphery of the housing and is provided with means for effecting angular adjustment which, by virtue of a screw thread, also effects axial adjustment.

As mentioned with reference to the annular groove 49, the bore is tapered on opposite sides of this groove and the same applies to the grooves in the bore in register with the grooves 39 and 50 and also in respect to the joint between the housing portions 11, 12. No provisions is made for preventing rotation of the pump assembly within the bore since it has been found that the frictional drag imposed by the various seal rings is sufficient to prevent such rotation.

We claim:

1. A fluid pump comprising a housing defining a bore, said housing being formed in two parts with the joint between the two housing parts extending substantially at right angles to the axis of the bore, an end wall forming part of the housing and closing one end of said bore, a detachable end closure forming an end wall closing the other end of the bore, a pump assembly located in said bore and including a drive shaft, an aperture in one end wall through which the drive shaft extends, the pump assembly further comprising three stator portions disposed in end to end relationship within said bore, resilient means acting between one end wall and the adjacent stator portion and acting to bias the stator portions axially into engagement with the other end wall, bearings carried by the end stator portions respectively and acting to support said shaft for rotation, said pump assembly also including a pair of pump units, said one pump unit being constructed to pump fluid at substantially twice the rate of the other pump unit, each pump unit comprising a fixed outer annular member, an inner annular member and a gear wheel, teeth found on the inner periphery of said inner annular member for engagement with the teeth of said gear wheel whereby as the gear wheel rotates in use the inner annular member will partake of gyratory movement within the outer annular member, means coupling said gear wheel to the shaft so that the gear wheel will be rotated thereby, a fluid inlet to the pump and a fluid inlet and fluid outlet for each pump unit, passage means connecting the pump fluid inlet to the inlet of one of the pump units, further passage means connecting the outlet of said one pump unit to the inlet of the other pump unit, a fluid outlet from the pump and still further passage means connecting the outlet of said other pump unit which said pump fluid outlet, valve means responsive to the inlet and outlet pressures of said other pump unit and operable to maintain the pressure drop between the inlet and outlet of said other pump unit substantially zero, whereby the rate of fluid flow through the pump fluid outlet will be proportional to the speed or rotation of the shaft, said valve means comprising a diaphragm disposed in a chamber, passage means whereby the diaphragm is subjected on opposite sides to the pressures at the inlet and outlet of said other pump unit and a valve element associated with said diaphragm and movable thereby said valve element controlling fluid flow from the inlet of said other pump unit to a drain, said chamber being defined between the housing parts and the peripheral edge of the diaphragm being located between said housing parts at the joint therebetween.

2. A fluid pump comprising a housing defining a bore, an end wall forming part of the housing and closing one end of said bore, a detachable end closure forming an end wall closing the other end of the bore, a pump assembly located in said bore and including a drive shaft, an aperture in one end wall through which the drive shaft extends, the pump assembly further comprising three stator portions disposed in end to end relationship within said bore, resilient means acting between one end wall and the adjacent stator portion and acting to bias the stator portions axially into engagement with the other end wall, bearings carried by the end stator portions respectively and acting to support said shaft for rotation, said pump assembly also including a pair of pump units each comprising a fixed outer annular member, an inner annular member and a gear wheel, the outer annular member of each pump unit being located between and held in engagement with the central stator portion and the respective end stator portion, teeth found on the inner periphery of said inner annular member for engagement with the teeth of said gear wheel whereby as the gear wheel rotates in use the inner annular member will partake of gyratory movement within the outer annular member, means coupling said gear wheel to the shaft so that the gear wheel will be rotated thereby, a fluid inlet to the pump and a fluid inlet and fluid outlet for each pump unit, passage means connecting the pump fluid inlet to the inlet of one of the pump units, further passage means connecting the outlet of said one pump unit to the inlet of the other pump unit, a fluid outlet from the pump and still further passage means connecting the outlet of said other pump unit with said pump fluid outlet, and valve means responsive to the inlet and outlet pressures of said other pump unit and operable to maintain the pressure drop between the inlet and outlet of said other pump unit substantially zero whereby the rate of fluid flow through the pump fluid outlet will be proportional to the speed or rotation of the shaft.

3. A fluid pump according to claim 2 including a flange carried by the shaft, said flange co-operating with one of said bearings to form a thrust bearing, a thrust member carried by the shaft and engaging with the other of said bearings and means retaining the thrust member on the shaft.

4. A fluid pump according to claim 2 in which said bearings are of annular form and are formed from carbon.

5. A fluid pump according to claim 2 in which said passage means and said still further passage means each include a circumferential groove formed in the respective end stator portion, and passages in the housing communicating with said circumferential grooves respectively.

6. A fluid pump according to claim 5 including circumferential grooves formed in the bore of the housing for registration with the grooves on the end stator portions respectively.

7. A fluid pump according to claim 6 including a pair of sealing means disposed on the opposite sides of each groove to prevent leakage of fluid from the grooves.

8. A fluid pump according to claim 2 in which said one pump unit is constructed to pump fluid at substantially twice the rate of said other pump unit.

9. A fluid pump according to claim 8 in which valve means comprises a diaphragm disposed in a chamber, passage means whereby the diaphragm is subjected on opposite sides to the pressures at the inlet and outlet of said other pump unit and a valve element associated with said diaphragm and movable thereby said valve element controlling fluid flow from the inlet of said other pump unit to a drain.

10. A fluid pump according to claim 2 in which the outer annular member defines a cylindrical recess the axis of which is offset relative to the axis of rotation of the shaft.

11. A fluid pump according to claim 10 including dowel pins extending between the end stator portions and the central stator portion respectively, said dowel pins also extending through the outer annular members of the pump units.

* * * * *